United States Patent [19]

Nebolsine

[11] 4,030,545

[45] June 21, 1977

[54] APPARATUS FOR CLEANSING WELL LINER AND ADJACENT FORMATIONS

[76] Inventor: Rostislav Nebolsine, 64 E. 86th St., New York, N.Y. 10028

[22] Filed: Mar. 15, 1976

[21] Appl. No.: 666,976

Related U.S. Application Data

[63] Continuation-in-part of Ser. No. 539,111, Jan. 7, 1975, Pat. No. 3,945,436.

[52] U.S. Cl. ..... 166/191; 166/187; 166/312

[51] Int. Cl.[2] ..... E21B 33/124; E21B 33/127; E21B 43/25

[58] Field of Search ..... 166/191, 311, 312, 185, 166/147, 307, 303

[56] References Cited

UNITED STATES PATENTS

| | | | |
|---|---|---|---|
| 2,221,775 | 11/1940 | Boynton | 166/146 X |
| 2,290,141 | 7/1942 | Burt | 166/312 |
| 2,675,876 | 4/1954 | Conrad et al. | 166/185 X |
| 2,824,612 | 2/1958 | Lynes | 166/191 X |
| 2,893,493 | 7/1959 | Copas | 166/191 X |
| 3,247,904 | 4/1966 | Wakefield, Jr. | 166/185 X |

*Primary Examiner*—Stephen J. Novosad
*Attorney, Agent, or Firm*—Darby & Darby

[57] ABSTRACT pg,1 First, a cleansing fluid is injected under high pressure into a well liner and out through the apertures in the liner so as to travel through a particular slice of the underground formation adjacent the lining in order to dissolve chemical deposits and dislodge physical obstructions. Then, an entraining fluid is injected into the well liner under high pressure and into the formation in order to entrain the dissolved or dislodged particles in the formation and carry them into the well. Next, the captured particles are pumped out of the well to the surface for eventual disposal. The cleansing and entraining fluids are injected into a flexible hose which is connected to a high pressure source. The hose is surrounded by a pipe which carries the particles flushed from the underground formation to the surface. The pipe is surrounded by a series of packers which are inflated by the injected fluids. Outlet ports for the injected fluids are positioned between — in vertically descending order — first and second packers and between third and fouth packers; an inlet port for the entrained fluid is positioned between the second and third packers. In another embodiment the pipe is formed in sections, each section having ends which terminate in the vicinity of the terminal ends of the respective packer which surrounds it. The packers are formed with flexible walls which extend over the space between adjacent packers defining flexible joints so that the adjacent pipe sections are articulated.

7 Claims, 5 Drawing Figures

APPARATUS FOR CLEANSING WELL LINER AND ADJACENT FORMATIONS

This application is a continuation-in-part of application Ser. No. 539,111 filed Jan. 7, 1975 , now U.S. Pat. No. 3,945,436.

This invention generally relates to a method and apparatus for cleansing well liners and the formation adjacent the well liner or surrounding a drilled-in open hole and has particular applicability with respect to oil wells.

Generally, the production of oil or other fluids from underground wells drop off due to three main causes. The first cause is that the extraction of the fluid from the confined underground formation results in a drop of pressure in the remaining fluid present in that section of the underground formation. The second cause is due to the obstruction of the apertures in the liner (or casing) of the well, due to either physical blocking of these openings by particles detached from the underground formation or by chemical deposits within the openings. The chemical deposits result from the release of gases by the fluid due to a drop in pressure in the fluids as they enter the well. The release of gases causes precipitation of certain chemicals that were held in solution at the higher pressures.

A third cause relates to obstructions that are created in the underground formation itself, particularly obstructions that are close to and adjacent to the wall liner or the drilled-in open hole. As fluid (oil) is extracts from the underground formation, the smaller loose grains of sand or detached particles from the consolidated strata or debris that is forced out into the underground formation by well aperture cleansing operation, are entrained by the fluid moving towards the well. All such loosened material does not pass through the well liner apertures. Some of it is lodged against the liner and some of it fills up the voids in the formation surrounding the liner. This results in a reduction in the permeability of the underground formation in the particular zone where transmissability is most desirous. Also, the loss in pressure of the fluid approaching the well, described above, causes the precipitation of certain chemical deposits into the formation adjacent the well liner and further reduces the permeability of the formation. Both the physical and chemical clogging of the formation adjacent the well liner are cumulative in effect so that the production of fluid from a well drops and may cease altogether as a result of this third cause.

With respect to the second cause, efforts have been directed to removing the obstructions and deposits in the apertures in the well casings or liners by successively injecting cleansing fluids through the apertures of a particular section of the well liner that is sealed off by closely spaced, non-elongated upper and lower packers. This injection continues for a period sufficient to dissolve or weaken and detach the particles or deposits in the apertures. The debris enters the well together with the pressurized fluid through apertures either above or below the isolated section of the well. The debris is either carried upward with the fluids being pumped out of the well or permitted to drop to the bottom of the well from which it can be later removed by a bailer-type device. Such operations using appropriate cleansing apparatus and cleansing fluid have been effective in opening up the apertures in well casings and liners quite effectively thereby increasing the permeability of the well casing or liner.

This invention is primarily directed to solving the third cause of fluid production drop-off discussed above by selectively reaching and treating the affected portions of the underground formation nearest the well and most affected by clogging due to physical obstructions and chemical deposits. Briefly, the method of this invention consists of first, injecting an acid or some other cleansing or caustic fluid through the apertures in an isolated section of the well liner. The purpose of this step is to loosen or dissolve the physical and chemical deposits in the underground formation adjacent the well liner. The second step involves injecting water or steam or any suitable fluid or gas into the underground formation adjacent the well to entrain the dissolved or detached physical or chemical deposits and cause such deposits to enter the well through the well liner apertures. The third step involves removing the entrained deposits as they enter the well by pumping the fluid to the surface or by lowering a suction tube into the well.

In order to effectively practice the method of this invention, a specific apparatus has been developed. Briefly described, this apparatus consists of a series of elongated packers which surround a centrally located section of pipe which is hung from a smaller diameter flexible hose or pipe which extends within the first pipe and which is fed from a large diameter winch or drum at the surface. A cable may also be used as an auxiliary support for the apparatus.

In a preferred embodiment of my invention, the innermost hose or pipe is used to transport the fluid which is injected into the formation adjacent the well liner. A fluid outlet is located between a first elongated packer and a second elongated packer and a fluid inlet which leads to the outermost pipe is located between the second elongated packer and a third elongated packer. Another fluid outlet may be located between the third elongated packer and a fourth elongated packer. This results in a relatively lower pressure zone being formed between the second and third elongated pakcers. Consequently, when fluid is injected into and through the innermost pipe under high pressure, it is ejected through the fluid outlet ports between the first and second packers and the third and fourth packers, through the apertures in the well liner and into the underground formation directly adjacent and outside of the well liner. Since the fluid is under high pressure, it necessarily travels towards the lower pressure zone between the second and third elongated packers, as described in more detail below.

It is important that the packers between the fluid outlet ports and the fluid inlet ports be elongated so that the first injected fluid travels a sufficient distance through the underground formation to dissolve the chemical deposits and loosen the physical obstructions in the underground formation adjacent the well liner and so that the second injected fluid entrains the dissolved chemical deposits or detached physical obstructions and causes such particles to enter the well through the well casing liner at the low pressure zone between the elongated packers. The elongated packers serve to maintain a high pressure barrier along the well liner to prevent the fluid which is injected into the underground formation from short-circuiting back into the well without traveling through the underground formation. This happens when non-elongated disc-type packers are closely spaced. The length of the elongated packers positioned between the fluid outlet ports and the fluid inlet zone determine the shape of the fluid flow net which in turn determines the radial distance from the center of the well to which the underground formation is treated according to the method of this invention.

In practicing the method of my invention, the apparatus described above is lowered into a well by a flexible pipe or cable. The apparatus is lowered to a section of the underground formation that it is desired to treat according to the method of this invention. When the apparatus of my invention is being lowered into the well, the packers are in a deflated condition so as not to obstruct the descent of the apparatus down the well which may not be straight. When the section of the underground formation to be treated has been reached, a cleansing or caustic or solvent fluid under high pressure is injected into the innermost pipe, into the inflatable packers and through the fluid outlet ports located between the first and second packers and the third and fourth packers. This automatically inflates the packers which engage the walls of the liner or, in the case of an open hole, the exposed cylindrically shaped surface of the formation. The high pressure fluid is given sufficient time to travel the length of the elongated packers to the low pressure zone between the second and third packers. Then, after a period of time, a second high pressure fluid is injected into the innermost pipe and out through the outlet ports into the underground formation to entrain the loosened chemical deposits and physical obstructions. The entraining fluid is given sufficient time to capture the physical and chemical particles and cause them to be moved through the low pressure zone between the second and third packers and then upward through the centrally located pipe. The removal of the debris from the well can be aided by means of an air lift or suction pipe lowered into the casing. If the deposits fall to the bottom of the well, they may later be removed by a bailer-type device.

In the practice of the invention, it has been found to be advantageous to form the apparatus, which is by nature of its intended use, relatively long and thin, in an articulated fashion. More particularly, in order to facilitate the insertion of the apparatus into the well casing, it is desirable, in lieu of providing the outer pipe as a unitary member, to form this pipe in sections, each section having ends which terminate in the vicinity of the terminal ends of the respective packer which surrounds it. The packers are formed with flexible walls which extend over the space between adjacent packers thereby defining flexible joints so that adjacent pipe sections are articulated. Such structure enhances the ease with which the apparatus may be inserted into the well casing by obviating the necessity of substantially aligning the axes of the well casing and a long, unitary outer pipe member.

In the event that there is a great accumulation of loose particles lodged against the walls of the casing or liner, it may be necessary to cut additional apertures in the well liner at such points or to enlarge the apertures that are there so as to be able to remove these deposits from the well. After a particular slice of the underground formation adjacent the well casing has been cleansed, the packers are deflated, the apparatus is lowered or raised to the next section to be cleansed and the operation described above is repeated. This can be programmed automatically.

The effect of practicing the method of my invention is that the permeability of the underground formation adjacent the well liner is increased so as to permit the greater flow of fluid, particularly oil, towards and into the well.

Structural features of the invention and the complete nature thereof will become increasingly apparent following a consideration of the ensuing specification and the appended claims in which the invention is defined, particularly when taken in conjunction with the accompanying illustrative drawings setting forth a preferred embodiment of the invention.

DESCRIPTION OF A PREFERRED EMBODIMENT

Figure 1A:
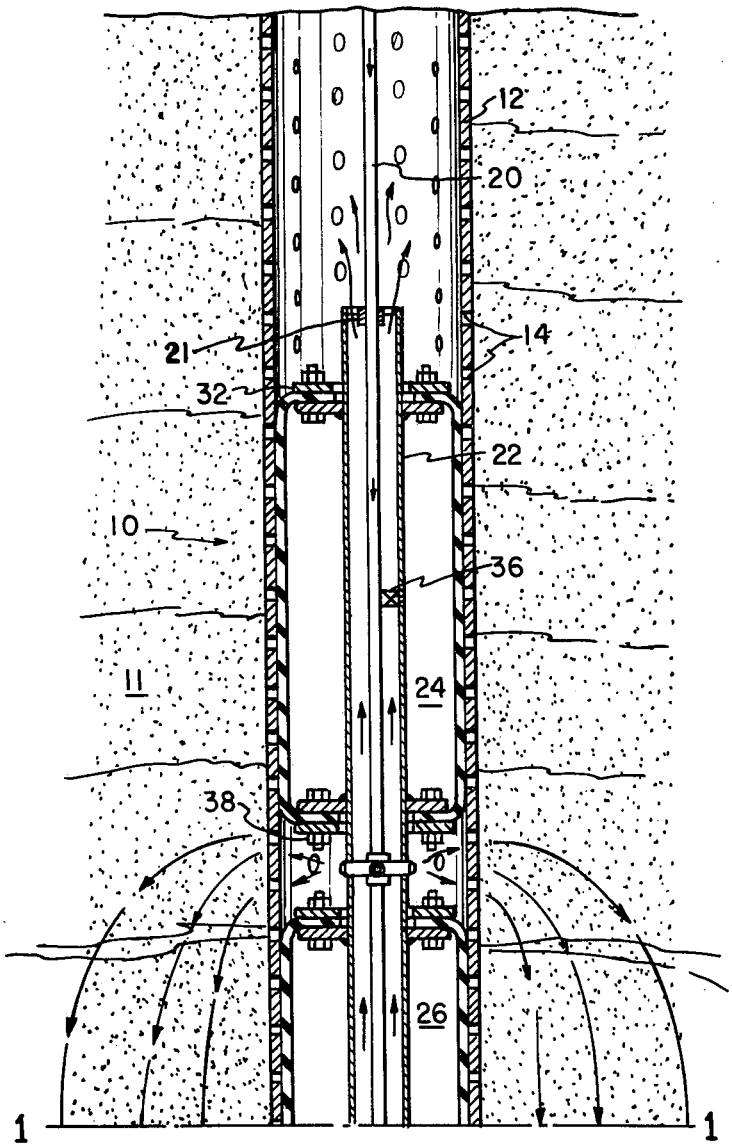
FIG. 1A is a cross-sectional view of a portion of a well showing the uppermost portion of the apparatus of this invention.

Referring to FIG. 1A, a portion of a well 10 in an underground formation 11 is illustrated. The well is defined by a well casing or liner 12 which contains numerous perforations or apertures 14. The purpose of these apertures is, of course, to permit the water or oil in the adjacent underground formation to enter into the well. Well liners in the vicinity of oil-producing formations are generally 6 to 15 inches in diameter.

The apparatus of this invention is lowered into the well by a flexible hose or pipe 20 approximately 1 inch in diameter. Flexible pipe 20 consists of a continuously welded steel pipe that is wound and unwound from a large diameter drum well known in the oil-drilling industry. A cable (not shown) can be used to help support the well-cleansing apparatus. On the surface, the pipe 20 is connected to sources (not shown) of high pressure fluids using a drum designed for this purpose.

Surrounding the inner pipe 20 is an outer pipe 22 which is generally 2 to 4 inches in diameter. The outer pipe 22 is attached to and hung from the inner pipe 20 by a welded web connection 21.

Surrounding the outer pipe are a series of packers which are referred to here in descending order as the first packer 24, the second packer 26, the third packer 28, and the fourth packer 30. Packers 24, 26, 28 and 30 each comprise unitary inflatable members which may be composed of rubber or any other suitable inflatable material. Packers 24, 26 and 28 are fastened to U-shaped flanges 32 which are welded onto the outer surface of outer pipe 22 and which extend radially outwardly from pipe 22. The upper portion of packer 30 is also fastened to a U-shaped flange welded to outer pipe 22. The bottom portion of packer 30 is fastened to the base of the penetration cone 34 which is the first part of the apparatus to enter the well.

The packers 24, 26, 28 and 30 may range in size from two to five times the diameter of the well liner. If the well liner has a small diameter, the length of the packer would tend to be closer to five times the size of the well liner diameter whereas if the diameter of the well liner is large, the length of the packer would tend to be closer to two times the diameter of the well liner. Thus, depending on the size of the well liner, the length of the packers 24, 26, 28 and 30 would be in the range between one and a half feet and four feet. The elongation of the packers 24, 26, 28 and 30 is important in order to insure that the fluid which is injected into the formation adjacent the well casing or liner actually travels through the formation in curvilinear paths rather than short-circuiting back towards the apertures in the well liner as occurs with closely spaced, non-elongated packers. Movable collars (not shown) could be attached to the outer pipe 22 in place of the welded flanges 32 so that the pipe 22 could accommodate packers of various dimensions, depending on well size and the permeability of the formation to be cleansed.

In the preferred embodiment illustrated in the drawings, the packers 24, 26, 28 and 30 are approximately seven inches in diameter, when inflated.

When the apparatus of this invention is lowered into the well, the packers 24, 26, 28 and 30 are initially deflated so as not to offer any resistance to the lowering of the apparatus into the well casing or liner. When the apparatus is positioned adjacent the underground formation to be cleansed, the packers 24, 26, 28 and 30 are inflated by connecting the hose 20 to a high pressure fluid supply (not shown) which inflates the packers through inlet ports 36. The packers 24, 26, 28 and 30 are inflated sufficiently to form a fluid-tight seal with the inner walls of the well liner.

Initially, the fluid under high pressure to which hose 20 is connected consists of an acid or detergent or deemulsifier or caustic fluid. This fluid, which will be generally referred to as a cleansing fluid, is supplied to inner pipe 20 and injected into the underground formation directly adjacent the well liner through fluid outlet ports 38 and 40 and then through the apertures 14 in the well liner. It is noted that port 38 extends outwardly past outer pipe 22 whereas the port 40 does not. The port 40 may also extend outwardly past outer pipe 22 but it is not necessary in the embodiment of my invention illustrated in the drawings because packing material 42 is provided around inner pipe 20 for the entire length of the third packer 28. This packing material 42 prevents the cleansing fluid from traveling up outer pipe 22. Slots 46 are provided in the outer pipe 22 to provide an exit for the cleansing fluid emitted from port 40.

The cleansing fluid which is injected into the underground formation dissolves or loosens the physical and chemical deposits in the formation. Then, the hose 20 is connected to a supply (not shown) of a second fluid under high pressure. This second fluid may consist of water or steam or heated or unheated oil or any other suitable fluid which serves to entrain the loosened or dissolved particles in the underground formation and carry such particles into the well through the well casing or liner apertures. This fluid will generally be referred to as the entraining fluid. The entraining fluid enters inner pipe 20 and is emitted through outlet ports 38 and 40 in the same manner as the cleansing fluid. The entraining fluid travels through the underground formation, as indicated by the flow lines in FIGS. 1A and 1B, towards the low pressure zone which is located between the second packer 26 and the third packer 28. There, the entraining fluid, carrying the dissolved or detached physical and chemical deposits from the formation, enters the well through the well casing or liner apertures and enters outer pipe 22 through slots 44.

The elongated packers of this invention prevent the short-circuit entrance of the cleansing fluids or the entraining fluids which have been injected into the oil-producing formation back into the well. Thus, the paths of the pressurized cleansing and entraining fluids passing through the porous formation back into the well follow an equipotential type of flow net. This means that a considerable portion of the cleansing and entraining fluid will flow outwardly in arc-shaped paths that will bring the cleansing and dissolving fluids into contact with the formation at a considerable distance away from the circumference of the well casing or liner, as illustrated in the drawings, instead of moving vertically along the walls of the casing or liner into the apertures immediately above and below the dissolving and cleansing fluid injection zone. The horizontal distances to which the cleansing and entraining fluid flows depends on the length of the particular packers and the nature of the formation.

A suction pipe or air lift (neither shown) may be lowered into the well to pump the entraining fluid carrying the formation deposits to the surface for eventual disposal.

In the event that there is a great accumulation of particles at the low pressure zone between the second and third packers, it may be necessary to cut additional apertures in the well casing wall or liner at that point or to enlarge the apertures presently there in order to enable the particles to enter the well. This could be accomplished by numerous means well known in the art.

After the cleansing and entraining operations are performed in a particular slice of the underground formation, the packers 24, 26, 28 and 30 are deflated and the entire apparatus is raised or lowered in the well to the next position opposite a new slice of the formation at which the cleansing, entraining and debris removal operations are to be performed. Then, the entire operation described above is repeated. The supplying of cleansing and entraining fluids and the raising and lowering of a suction pipe and the cleansing apparatus can be programmed so that it is accomplished automatically.

Although the embodiment of my invention described above utilizes four packers, the method of my invention could be practiced by utilizing only the first and second packers and by locating the fluid inlet port 38 between the first packer and the second packer and locating the low pressure zone, that is, the slots 44 in pipe 22, below the second packer. This would provide a single flow net patent rather than the dual flow net pattern illustrated in the drawings.

As mentioned hereinabove, it has been found desirable in order to facilitate the insertion of the apparatus into the well casing, to from the apparatus in an articulated fashion. This will obviate the requirement that the axis of the outer pipe, which in the embodiment just described, is inherently relatively long, be substantially aligned with the axis of the well casing. The embodiment of the invention illustrated in FIGS. 2–4 provides such an articulated structure.

Figure 1B:
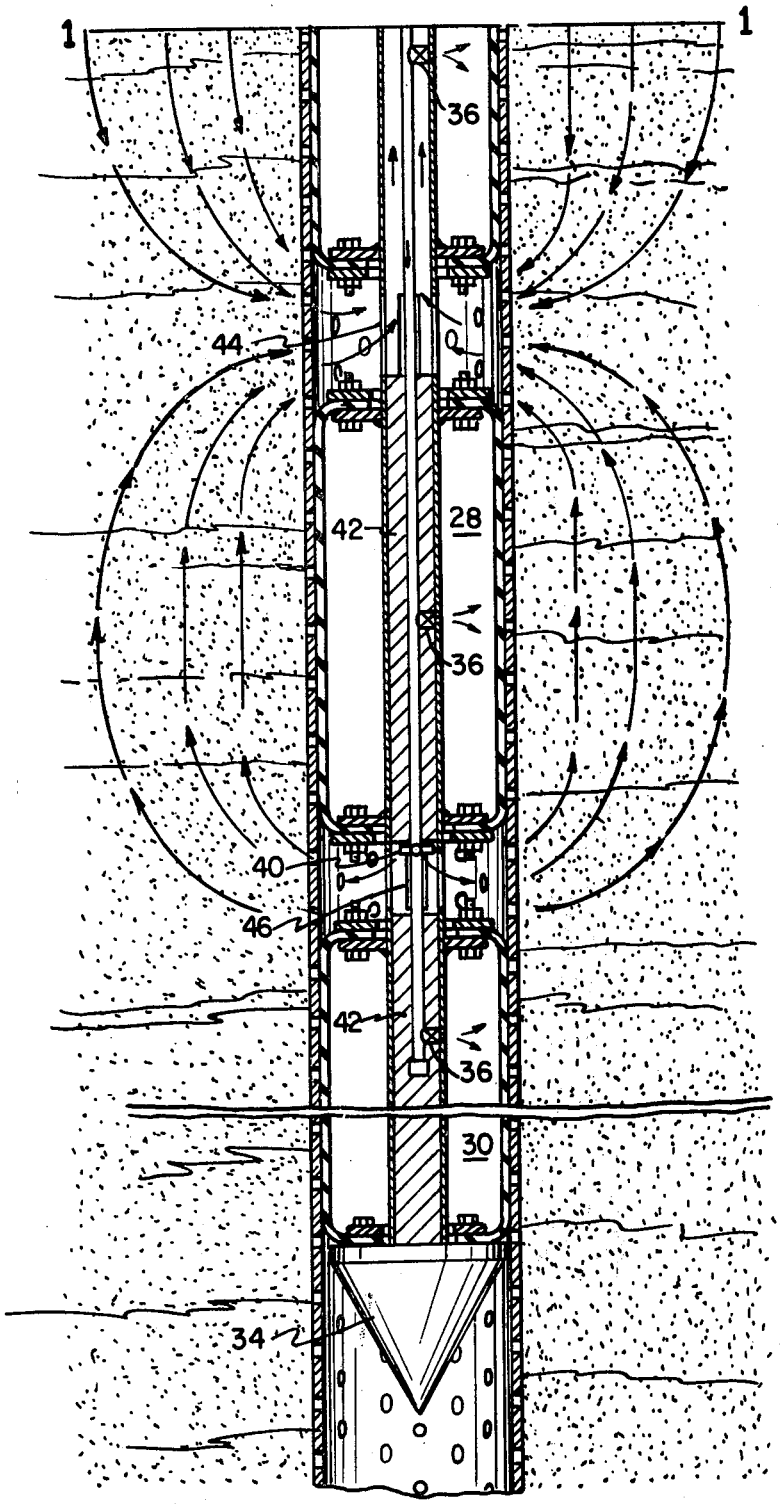
FIG. 1B is a cross-sectional view of a continuation of the well illustrated in FIG. 1A showing the lowermost portion of the apparatus of this invention.
Figure 2:
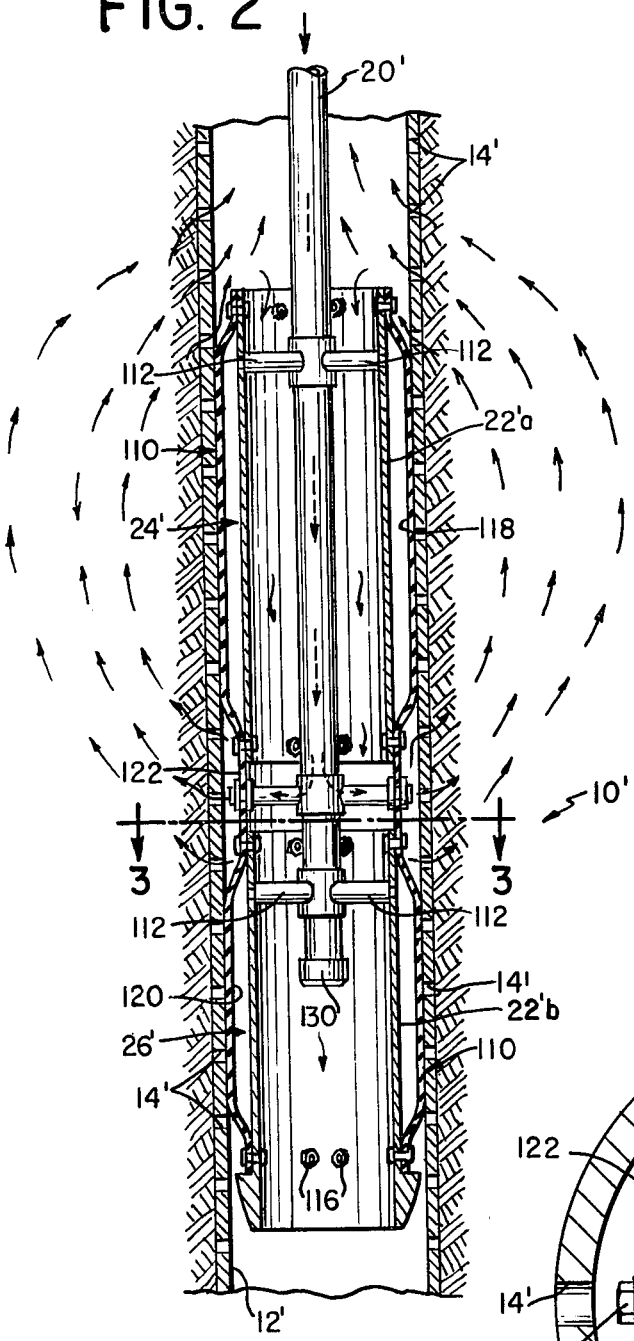
FIG. 2 is a view in partial cross-section of a portion of a well showing apparatus of another embodiment of this invention.
Figure 3:
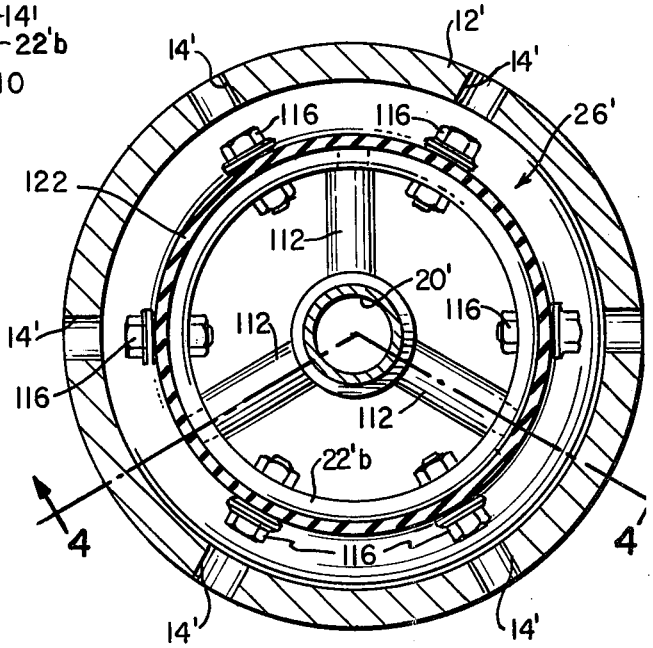
FIG. 3 is a sectional view taken along line 3—3 of FIG. 2.
Figure 4:
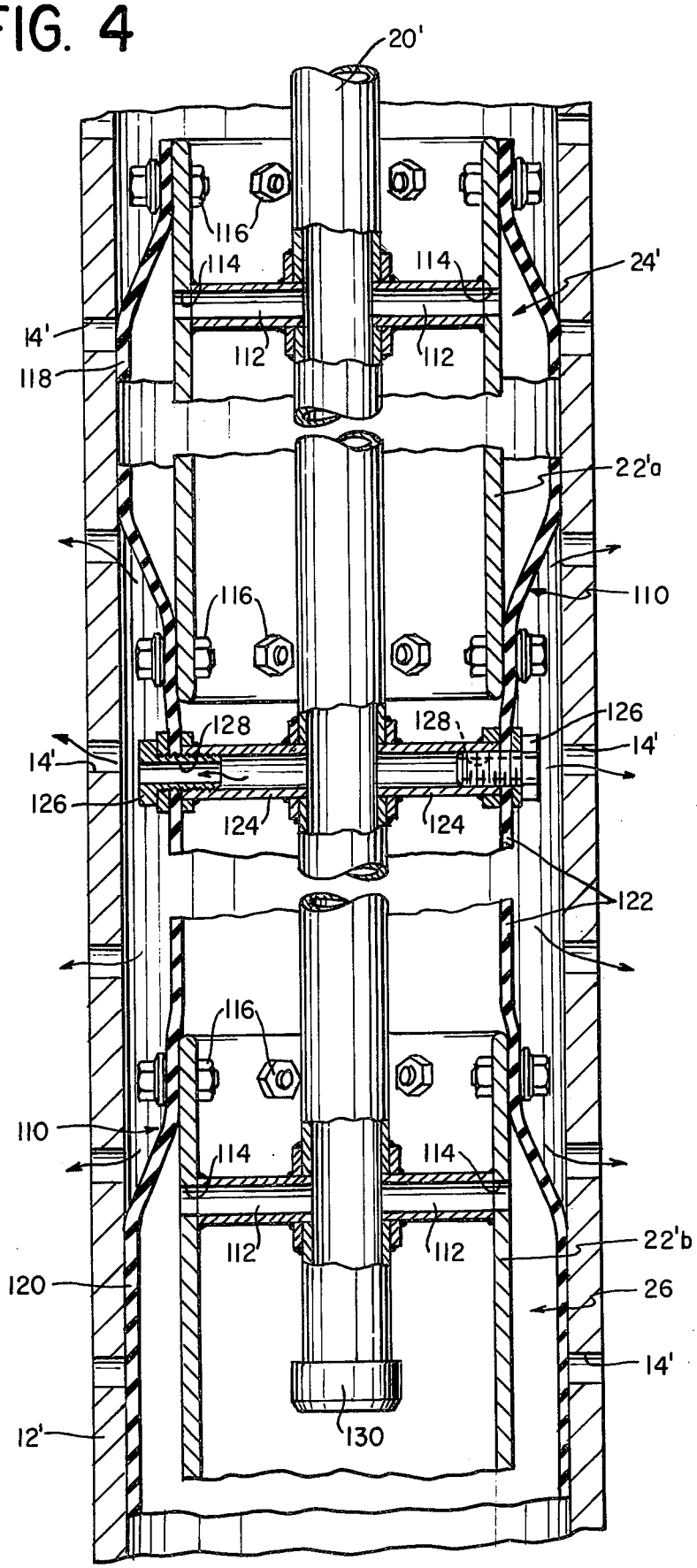
FIG. 4 is an enlarged view in partial cross-section of a portion of a well showing the uppermost portion of the apparatus of this invention shown in FIG. 2.

Referring to FIGS. 2–4, the elements of the invention illustrated therein which correspond to similar or identical elements shown in FIGS. 1*a* and 1*b* will be designated by the same numerals as those corresponding elements, primed.

The well 10′ is defined by a well casing 12′ which contains numerous apertures 14′ for the same purpose mentioned hereinabove. A flexible pipe 20' having the same material characteristics as described above relative to FIGS. 1*a* and 1*b*is similarly lowered into the well and connected to sources (not shown) of high pressure fluids.

Outer pipe sections 22'*a* and 22'*b* surround respective portions of the length of flexible pipe 20' and are partially supported thereby in a manner described in greater detail hereinbelow. Outer pipe sections 22'*a* and 22'*b* are preferably of somewhat larger diameter than that of outer pipe 22 of FIGS. 1*a* and 1*b*.

Surrounding the respective outer pipe sections are a series of packers (two being shown in the figures) including an upper packer 24' and a lower packer 26'. However, it is understood that more than two packers may be provided within the scope of the present invention. Packers 24' and 26' are preferably defined by an integrally formed outer wall 110 of rubber or other suitable inflatable material. The lengths of the packers are governed by the same considerations as and are within the limits specified hereinabove with respect to the packers illustrated in FIGS. *a* and 1*b* for the same specified reason. The lengths of outer pipe sections 22'*a* and 22'*b* are substantially the same as the lengths of the respective packer which surround them.

Referring to FIG. 4, at least one (three shown) fluid outlet passage 112 is provided in each space defined between each of the outer pipe sections and the respective portion of flexible pipe 20' surrounded thereby, the inner end of such passage being suitably connected to, as by welding, and fluidly communicating with the interior of flexible pipe 20'. The passages 112 radially extend from flexible pipe 20', their outer ends being connected to, as by welding, and communicating with apertures 114 formed in the respective outer pipe sections 22'*a* and 22'*b*. Flexible pipe 20' structurally supports outer pipe sections 22'*a* and 22'*b* via the passages 112.

Sections 118 and 120 of packer wall 110 are located in opposed relationship to the outer surface of the outer pipe sections 22'*a* and 22'*b*, respectively. The ends of each section 118 and 120 are sealingly engaged to the outer surface of the terminal ends of the outer pipe sections by any conventional means, such as by nut and bolt assemblies 116. The length of packer wall 110 extending between the ends of each respective outer pipe section is preferably somewhat greater than the distance between such ends or, in other words, each packer wall section 118, 120 is at least slightly slackened. This is to facilitate and allow for an increase in their diameter upon inflation as will be described below in connection with the operation of this embodiment of the invention.

As seen in FIGS. 2 and 4, a section 122 of packer wall 110 extends over the space between the lower end of outer pipe section 22'*a* and the upper end of outer pipe section 22'*b*. As packer wall 110 is formed of a flexible rubber-like material and inner pipe 20' is also relatively flexible, a joint is defined between the outer pipe sections by virtue of which the sections are articulated.

At least one fluid outlet passage 124 (three shown) is provided in the space defined between flexible pipe 20' and packer wall section 122, the inner end of such passage being suitably connected to, as by welding, and fluidly communicating with the interior of flexible pipe 20'. The passage 124 radially extend from flexible pipe 20', their outer ends being connected to, as by threaded bushings 126, and communicating with apertures 128 formed in packer wall section 122.

When the apparatus of the present embodiment of this invention is lowered into the well casing, packers 24' and 26' are initially deflated so that no resistance if offered by them. Due to the flexibility of the joint located between the adjacent outer pipe sections, the respective axes of the pipe sections and well casing need not be in substantial alignment. When the apparatus is positioned adjacent the underground formation to be cleansed, packers 24' and 26' are inflated by connecting flexible pipe 20' to a high pressure fluid supply (not shown) which inflates the packers through fluid outlet passages 112 and communicating apertures 114. Packers 24' and 26' are inflated sufficiently to form a fluid-tight seal with the inner wall of the well liner.

As was the case in the previous embodiment, initially, the fluid under high pressure to which pipe 20' is connected is a cleansing fluid and is injected into the underground formation through fluid outlet passages 124 and then through apertures 14' in the well liner. A cap 130 is provided over the lower end of flexible pipe 20' to close off that end.

As before, the cleansing fluid dissolves or loosens deposits in the formation. The pipe 20' is then connected to a high pressure source of entraining fluid which enters pipe 20', and is emitted through fluid outlet passage 124 and apertures 14'.

Referring to FIG. 2, this entraining fluid follows the flow path designated by the flow lines and reenters the well casing 12' through apertures 14'. A vacuum source may be provided at the upper end of the well casing to promote this flow. However, even in the absence of such a vacuum source, the fluid will tend to follow this path since the pressure within the well casing, which is slightly greater than normal atmospheric pressure, is substantially lower than the surrounding pressures. The fluid will then either exit through the upper end of the well casing (where vacuum is supplied) or will fall to the bottom of the well casing which is open at both ends where it can be disposed of by the bailer-type device mentioned hereinabove.

It is conceivable that upon examining the foregoing disclosure, those skilled in the art may devise embodiments of the concepts involved which differ somewhat from the embodiments shown and described herein, or may make various changes in structural details for the present embodiment. Consequently, all such changed embodiments or variations in structure as utilize the concepts of the invention and clearly incorporate the spirit thereof are to be considered as within the scope of the following claims.

What is claimed is:

1. Apparatus for cleansing well liners having apertures or the walls of an open cavity, and the adjacent underground formations, comprising:

a first substantially elongate outer pipe section adapted to be positioned within a well;

a second substantially elongate outer pipe section adapted to be positioned within a well, said second outer pipe section being positioned vertically below and spaced from said first outer pipe section;

an inner flexible pipe extending through and including means for supporting said first and second outer pipe sections having means on one end adapted to be connected to a high pressure fluid source;

a flexible packer wall enveloping and surrounding said first and second outer pipe sections having annular sections thereof which are located in substantially opposed relationship to the upper and lower end portions of each of said first and second outer pipe sections being sealingly engaged thereto, thereby defining first and second substantially elongate packers surrounding said first and second outer pipe sections, respectively;

a section of said packer wall being connected to and extending between the lower end portion of said first outer pipe section and the upper end portion of said second outer pipe section defining a flexible joint so that said first and second outer pipe sections and the respective packers associated therewith are articulated; and means defining a fluid outlet passage communicating with said inner flexible pipe and communicable with the adjacent underground formations.

2. Apparatus as recited in claim 1 wherein said first and second outer pipe sections have open ends.

3. Apparatus as recited in claim 1 wherein said fluid outlet passage is positioned between said first and second packers.

4. Apparatus as recited in claim 1 further including packer inflation passages including at least one fluid passage communicating with a respective one of said packers and said inner flexible pipe.

5. Apparatus for cleaning well liners having apertures or the walls of an open cavity, and the adjacent underground formations, comprising:

at least two substantially elongate outer pipe sections adapted to be positioned within a well, said outer pipe sections being positioned in substantial vertical, spaced axial alignment;

an inner, flexible pipe extending through and including means for supporting said outer pipe sections and having means on one end adapted to be connected to a high pressure fluid source;

at least two elongate packers, each of said packers surrounding a respective one of said outer pipe sections;

a flexible material connecting adjacent ends of adjacent outer pipe sections, thereby defining flexible joints so that said adjacent pipe sections and the respective packers associated therewith are articulated;

means defining a fluid outlet communicating with said inner flexible pipe and communicable with the adjacent underground formations; and said packers each having a length such that the sealed lengths of the liner or cavity are sufficiently long to cause the fluid, upon being applied to said inner pipe, to flow outwardly through the underground formation in arc-shaped paths at a distance away from the liner or cavity.

6. Apparatus as recited in claim 5 wherein the length of each of said packers is in the range of about two to five times the diameter of the well liner or open cavity within which said packers are to be positioned.

7. Apparatus as recited in claim 5 wherein said fluid outlet passage is positioned between adjacent packers.

* * * * *